US007161106B2

(12) United States Patent
Kohatsu et al.

(10) Patent No.: US 7,161,106 B2
(45) Date of Patent: Jan. 9, 2007

(54) SWITCHING DEVICE FOR FLEXIBLE MATERIAL

(75) Inventors: Shane S. Kohatsu, Portland, OR (US); Scott K. Hutsenpiller, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/703,221

(22) Filed: Nov. 6, 2003

(65) Prior Publication Data

US 2005/0098421 A1 May 12, 2005

(51) Int. Cl.
*H01H 1/02* (2006.01)

(52) U.S. Cl. ..... 200/511; 200/52 R; 200/341

(58) Field of Classification Search ..... 200/510–513, 200/52 R, 520, 341, 333
See application file for complete search history.

(56) References Cited

U.S. PATENT DOCUMENTS

| | | | | |
|---|---|---|---|---|
| 4,190,951 | A | 3/1980 | Armstrong | 29/628 |
| 4,729,377 | A | 3/1988 | Granek et al. | |
| 4,860,364 | A | 8/1989 | Giannini | 381/90 |
| 5,898,147 | A * | 4/1999 | Domzalski et al. | 200/1 B |
| 5,906,004 | A * | 5/1999 | Lebby et al. | 2/1 |
| 6,130,593 | A * | 10/2000 | Van Zeeland | 335/205 |
| 6,133,536 | A * | 10/2000 | Hunag et al. | 200/5 A |
| 6,319,015 | B1 * | 11/2001 | Faunce | 439/37 |
| 6,350,129 | B1 | 2/2002 | Gorlick | 439/37 |
| 6,486,427 | B1 * | 11/2002 | Pruvot | 200/406 |
| 6,580,043 | B1 * | 6/2003 | Spratte | 200/517 |
| 6,642,467 | B1 | 11/2003 | Farringdon | 200/511 |
| 6,737,595 | B1 * | 5/2004 | Fontaine | 200/85 A |
| 2002/0084901 | A1 | 7/2002 | Mantyjarvi et al. | |
| 2003/0080870 | A1 | 5/2003 | Marmaropoulos et al. | |

FOREIGN PATENT DOCUMENTS

| | | |
|---|---|---|
| DE | 30 20 010 | 5/1980 |
| DE | 198 13 704 A 1 | 9/1999 |
| WO | WO 02/40091 A2 | 5/2002 |
| WO | WO 02/059923 | 8/2002 |

OTHER PUBLICATIONS

International Search Report corresponding to PCT/US2004/032779 dated Feb. 4, 2005.
Website: "SOFTswitch make fabrics touch sensitive and interaction"; SOFTswitch Electronic Fabrics—About, copyrighted 2001.
International Search Report corresponding to PCT/US2004/032779 dated Jun. 2, 2005.

* cited by examiner

*Primary Examiner*—K. Lee
(74) *Attorney, Agent, or Firm*—Banner & Witcoff, Ltd.

(57) ABSTRACT

A switching device for use on flexible material includes a core member configured to be secured to and extend outwardly from a flexible material, a switch supported by the core member, and a cover. The switch is configured to be operably connected to an electrical device. The resistance required to activate the switch beyond that provided by the user's fingers is provided solely by the core member, the switch, the cover, or any combination thereof.

20 Claims, 3 Drawing Sheets

SWITCHING DEVICE FOR FLEXIBLE MATERIAL

FIELD OF THE INVENTION

This invention relates generally to switching devices, and, in particular, to switching devices to be secured to flexible materials.

BACKGROUND OF THE INVENTION

The recent proliferation and miniaturization of electronic devices such as two-way radios, portable music players, cell phones, personal data assistants (PDA's), training devices such as heart monitors, etc., has led to an increased demand for situations where such devices are used. For example, these and other devices are increasingly being used during athletic activities such as bicycle racing, triathlons and other timed competitions. Bicycle messengers often need to use devices such as two-way radios and/or cell phones while riding their bicycles. Like bicycle messengers, drivers of automobiles must also keep their eyes on the road, but at times desire to use such devices. Similarly, operators of machinery often need to pay close attention to the equipment with which they are working, but might need to operate an additional device.

Consequently, such devices are often being used in numerous and diverse ways, and often times in situations where it is important for the user to keep their eyes on the activity in which they are engaged, such as bicycling and driving. Also, many situations in which such devices are used are time sensitive, e.g., athletic competitions that can be won or lost by mere seconds, and the ability to use such a device quickly and easily could make the difference between winning and losing a race.

Further, operating devices when a user is clad in cold weather gear, e.g., wearing coats and gloves, can prove problematic. In such a situation, the user typically needs to shed their gloves and possibly open a zippered or otherwise closed pocket to access a switching device to operate the device.

A switch that needs to be depressed or moved, e.g., a button, knob, tab, slider, etc., needs a force to provide feedback against the action of operation of the switch, a switch that exists on a flexible material lacks the functionality of a traditional switch that exists on rigid material. Some known devices have incorporated a textile control pad or switch directly in the surface of clothing, such as a jacket. By pressing a button with a finger, a user can operate the switch. However, such a switch requires a user to use their arm or other portion of their body as resistance in order to operate the switch, which can be awkward, especially when a user is moving, or performing another task, such as riding a bicycle or driving a car. Additionally, a user must look at the clothing to find the switch before it can be operated. This can be problematic when the user is engaged in a time sensitive activity such as an athletic competition, or when the user needs to keep their eyes focused on another task.

Thus, it would be desirable for an individual to be able to quickly access and operate a switching device that is secured to a flexible material, e.g., an article of clothing, without needing to look at the surface of the material to find the switching device, and without removing layers of clothing. Additionally, it would be desirable to have a switching device that does not require the user to use a part of their body other than their fingers to provide resistance in order to operate the switching device.

It is an object of the present invention to provide a switching device for flexible material that reduces or wholly overcomes some or all of the difficulties inherent in prior known devices. Particular objects and advantages of the invention will be apparent to those skilled in the art, that is, those who are knowledgeable or experienced in this field of technology, in view of the following disclosure of the invention and detailed description of certain preferred embodiments.

SUMMARY

In accordance with a first aspect, a switching device for use on flexible material includes a core member configured to be secured to and extend outwardly from flexible material, a switch supported by the core member, and a cover. The switch is configured to be operably connected to an electrical device. The resistance required to activate the switch beyond that provided by the user's fingers is provided solely by the core member, the switch, the cover or any combination thereof.

In accordance with another aspect, a switching device for use on flexible material includes a piece of flexible material, a core member secured to the flexible material, and a cover. A switch is supported by the core member and configured to be operably connected to an electrical device. Resistance required to activate the switch beyond that provided by the user's fingers is provided solely by the core member, the switch, the cover, or any combination thereof.

In accordance with yet another aspect, an article of apparel has at least a portion thereof formed of flexible material. A switching device is secured to the flexible material and is operable to operate an electrical device. The switching device includes a core member, an electrical switch supported by the core member, and a cover. The electrical switch is configured to be operably connected to an electrical device. The resistance required for a user to operate the switching device beyond that provided by the user's fingers is provided solely by the core member, the electrical switch, the cover or any combination thereof.

In accordance with a further aspect, an electrically operated component for use on flexible material includes an electrically operated component and a metallic snap fastener. The fastener has a first portion secured to the electrically operated component and a second portion configured to be secured to a piece of flexible material. The first portion includes a first pair of metallic snap members. The second portion includes a second pair of metallic snap members configured to mate with the first pair of metallic snap members. A retaining member formed of an elastic material has a cavity formed therein. The cavity is configured to elastically receive the electrically operated component.

Substantial advantage is achieved by providing a switching device for flexible materials. In particular, a device in accordance with the present invention can be located and operated by a user without the need to look directly at the switching device. This is highly advantageous since it can save the user time, which may be critical in certain situations, and can also allow the user to keep their attention focused on another task, such as driving. Furthermore, a device in accordance with the present invention can advantageously be operated without a user needing to use a part of their body other than their fingers to provide resistance when activating the switching device.

These and additional features and advantages of the invention disclosed here will be further understood from the following detailed disclosure of certain preferred embodiments.

Figure 1:
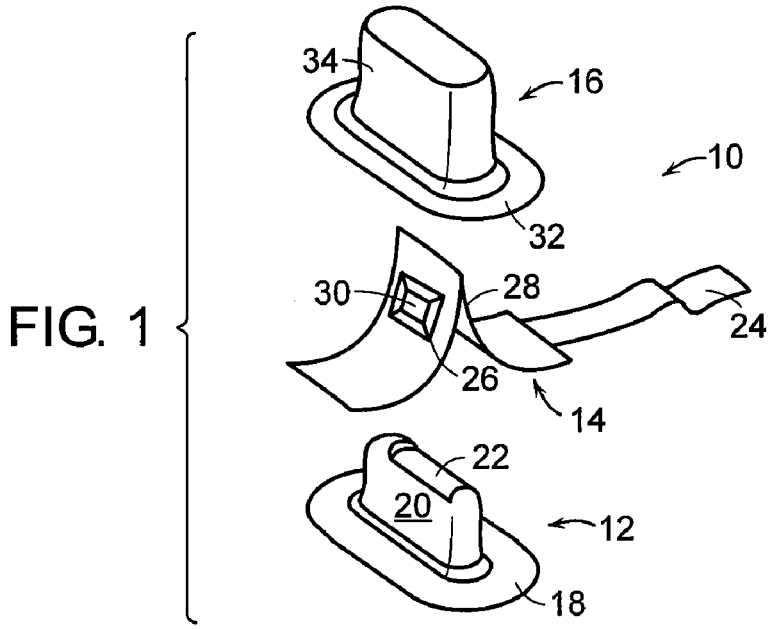
FIG. 1 is a perspective view, in exploded form, of a switching device in accordance with a preferred embodiment of the present invention.

The figures referred to above are not drawn necessarily to scale and should be understood to present a representation of the invention, illustrative of the principles involved. Some features of the switching device depicted in the drawings have been enlarged or distorted relative to others to facilitate explanation and understanding. The same reference numbers are used in the drawings for similar or identical components and features shown in various alternative embodiments. Switching devices for flexible materials as disclosed herein, would have configurations and components determined, in part, by the intended application and environment in which they are used.

DETAILED DESCRIPTION OF CERTAIN PREFERRED EMBODIMENTS

Figure 2:
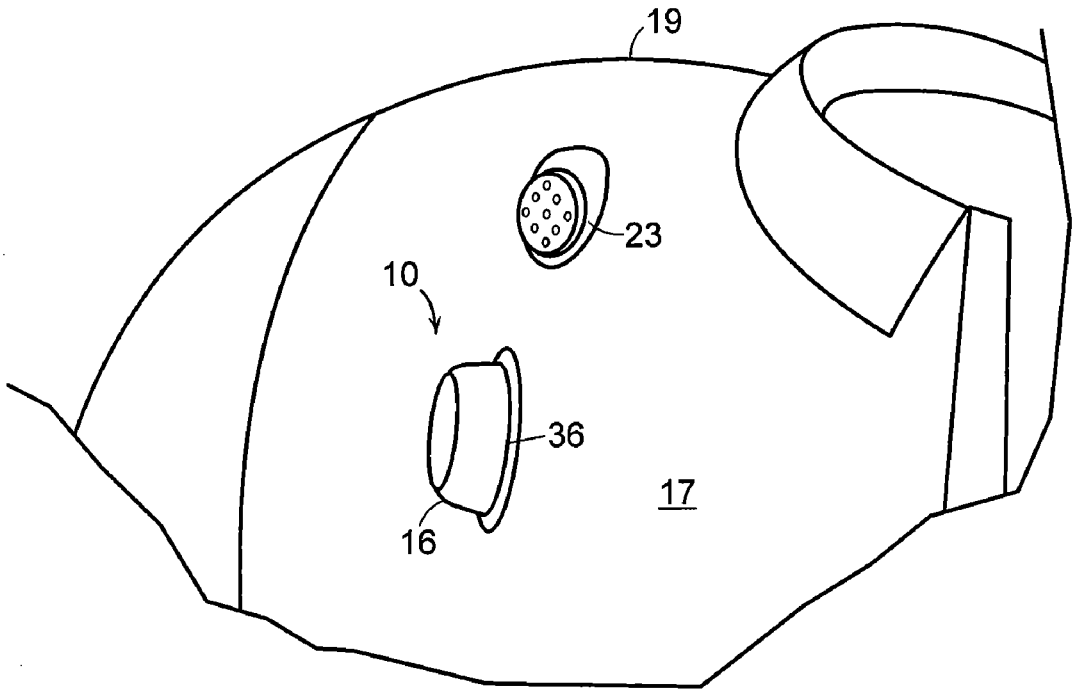
FIG. 2 is a perspective view of the switching device of FIG. 1, shown secured to an article of apparel.

The present invention may be embodied in various forms. A preferred embodiment of a switching device 10 in accordance with the present invention is shown in FIGS. 1–2. Switching device 10 includes a core member 12, an electrical switch 14, and a cover 16, and may be secured to a piece of flexible material 17. Material 17 may be a portion of an article of clothing, such as a jacket 19 as illustrated in FIG. 2. It is to be appreciated that switching device 10 can be incorporated in any flexible material including, but not limited to, clothing, bags, harnesses, slings, straps, footwear, upholstery, etc. Such items may be formed of woven and non-woven materials, textiles, fabrics, extruded sheets, and molded surfaces.

Core member 12 includes a flange portion 18 and a raised portion 20. A channel 22 is provided at the outermost exterior edge of raised portion 20. In a preferred embodiment, core member 12 is formed of a material that has a high density such that it has sufficient rigidity to provide some resistance for a user when activating electrical switch 14. Exemplary materials for core member 12 include thermoplastic elastomers and thermoplastic rubber, thermal plastics, thermal set rubber, thermal set epoxies, thermal set resins, and expanded foams. In a preferred embodiment, core member 12 is rigid enough to provide sufficient resistance to a user activating switching device 10.

Electrical switch 14 is operably connected to a device to be actuated, such as a two-way radio, portable music player, mobile phone, GPS device, personal data assistant (PDA), light, horn, siren, etc. In the embodiment illustrated in FIG. 2, switching device 10 is a push-to-talk (PTT) switch that operates a microphone 23, which may be, e.g., part of a two-way radio or mobile phone.

As seen in FIG. 1, electrical switch 14 is connected to a conductive textile or flexible cable 24, which in turn is operably connected to a device, such as a two-way radio or other device. Electrical switch 14 is wrapped over the surface of core member 12 and is received in channel 22 in a nesting manner. Electrical switch 14 may be a touch-sensitive textile switch, such as that provided by Softswitch of West Yorkshire, United Kingdom. Such a switch is advantageous in that in can be washed and dried, and has the ability to withstand the elements, such as rain and snow. It is to be appreciated that many types of switches would be suitable to provide the function of electrical switch 14, including mechanical buttons, actuators, mechanical metallic contacts, non-mechanical sensors, etc. Suitable switch types will become readily apparent to those skilled in the art, given the benefit of this disclosure. A traditional consumer electronics solution also may include a printed circuit board (PCB) or circuit board (CB).

It is to be appreciated that electrical switch 14 can be comprised of a single switching element or more than one switching element. In the illustrated embodiment, electrical switch 14 includes a first switch 26 and a second switch 28. In certain preferred embodiments, first switch 26 and second switch 28 may be connected in series, in which case both first switch 26 and second switch 28 must be activated. Providing two switching elements in series can reduce the chance that switching device 10 will be activated accidentally. In other embodiments, first switch 26 and second switch 28 could be connected in parallel, and could each perform different functions.

In the illustrated embodiment, each of first switch 26 and second switch 28 are provided with a tactile response dome 30. Tactile response dome 30 gives the user a positive tactile feedback and audible click when pushed. This allows the user to know when a switch has been actuated without the aid of visual confirmation. This can be advantageous in situations where the individual is engaged in a time critical activity, or in an activity that demands the user's undivided attention. A light can also be used to indicate actuation of the switch, as well as a synthetically produced sound, such as a beep or other tone that is played through a speaker.

If a mechanical actuator is used, tactile feedback may be provided by integrating the tactile feedback into the switch itself.

Cover 16 is positioned over electrical switch 14 and core member 12 when switching device 10 is assembled. Cover 16 has a flange portion 32 and a raised portion 34, which are configured to mate with flange portion 18 and raised portion 20, respectively, of core member 12. Exemplary materials for cover 16 include thermoplastic elastomers, thermoplastic urethanes, thermal plastics, expanded foam, and molded fabric.

In use, a user grasps and pinches the sides of cover 16 of switching device 10, depressing and activating first and second switches 26, 28 of electrical switch 14, thereby operating the connected device, such as microphone 23. Tactile response domes 30 provide a tactile and audible indicator to the user that switch 14 has been activated and that speaker 23 is operational.

Switching device 10 may be secured to material 17 in any suitable manner. For example, switch may be secured to material 17 by direct-injection molding, adhesive, sewing, ultrasonic welding, heat welding, screw fastener, rivets, or any other suitable fastening method. In a preferred embodiment, as illustrated in FIG. 2, raised portion 34 of cover 16 protrudes through an aperture 36 formed in material 17, with flange portion 32 being secured to material 17 by any of the fastening means disclosed above, or any other suitable fastening means.

By providing switching device 10 such that it extends outwardly from the surface of material 17, a user can locate switching device 10 by touch, thereby eliminating the need for a user to look at the surface of material 17 as they attempt to locate switching device 10. This can save time for the user, which may be critical when they are engaged in a timed athletic competition. This can also provide a safety advantage, since the user need not take their eyes off the activity in which they are engaged in order to operate switching device 10. For example, when someone driving a vehicle or riding a bicycle needs to use switching device 10, they can concentrate on the traffic around them while at the same time operating switching device 10 and using a device such as a two-way radio or cell phone.

The switch or switches of switching device 10 and also have surface detail, such as an embossed symbol or number, on the exterior surface of cover 16 to help a user register their fingers over the switches both in a tactile and visual manner.

Since the material to which switching device 10 is secured may be fairly large, switching device can also be larger than that found on traditional hand-held electronic products. The ability of switching device 10 to have a larger size enhances its usability during activities such as sports, outdoor activities, vehicle and machine operation, or for the visually impaired. Further, a larger switching device allows a user to operate it while wearing gloves.

In certain preferred embodiments, switching device 10 protrudes a significant amount from material 17, thereby allowing a user to easily find switching device 10 solely by feeling for it with their fingers. Additionally, by providing switching device 10 with a significant protrusion from material 17, a user is able to access and activate switching device 10 even if the item that incorporates switching device 10 is worn by a user underneath another layer of clothing, or if the user is wearing gloves. Thus, if a user were to wear another jacket, sweater, or other item of clothing on top of jacket 19, they would still be able to locate switching device 10 by feel, and activate it without the need to look down, or remove a layer of clothing.

The construction of switching device 10 provides an operational advantage as well. The resistance required for a user to operate switching device 10 is provided solely by the components of switching device 10 and the user's fingers. In the illustrated embodiment, core 12, electrical switch 14 and cover 16 in concert with the user's fingers provide the resistance necessary to operate switching device 10. To operate switching device 10 in the embodiment illustrated in FIGS. 1–2, a user grasps switching device 10 between two fingers, e.g., thumb and index finger or thumb and middle finger, and squeezes them together. Resistance for each finger is provided solely by the user's other finger and the components of switching device 10. This is in contrast to prior art devices that require a user to use a portion of their body to provide resistance, such as an arm.

In certain preferred embodiments, switching device 10 may protrude approximately 0.5 inches to approximately 2 inches outwardly from material 17. This distance provides a suitable purchase for a user trying to activate switching device 10, whether or not jacket 19 is located under another article of clothing, without the need to look at jacket 19 when trying to locate the switch. It is to be appreciated that the dimensions of switching device 10, and the distance it protrudes from material 17, can vary based on the function and purpose of switching device 10, and the environment in which it is used.

In another preferred embodiment, core 12 could be formed as a portion of material 17 that is molded such that it extends outwardly from the surface of material 17.

Figure 3:
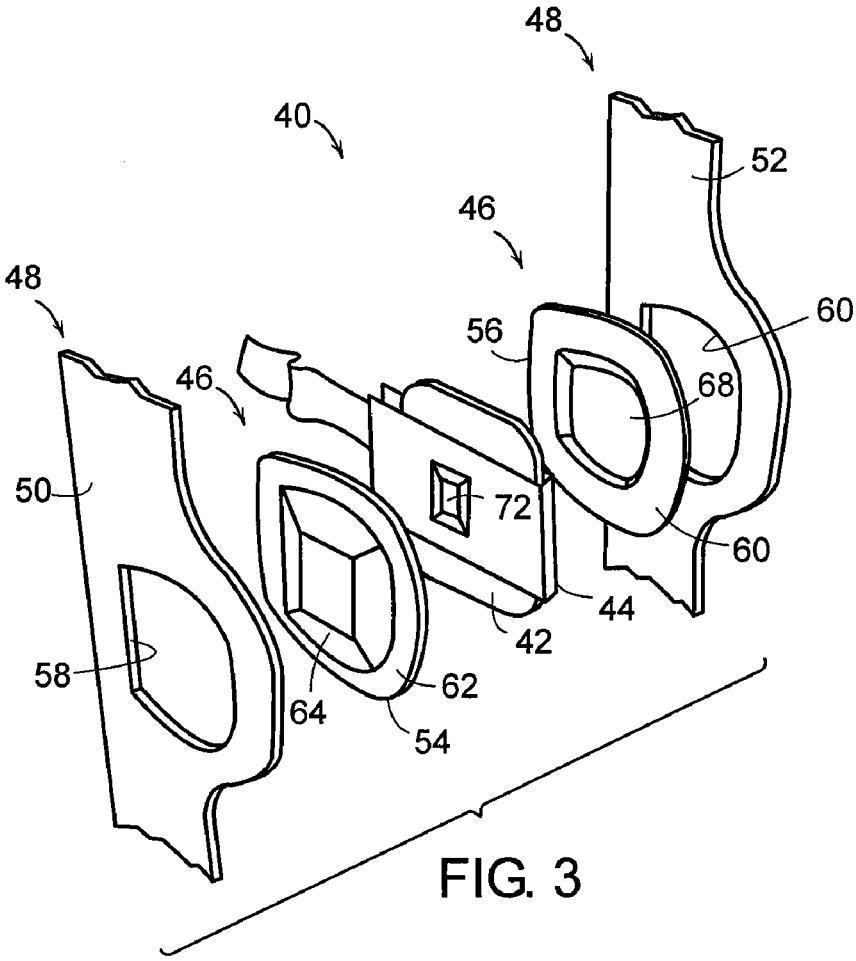
FIG. 3 is a perspective view, in exploded form, of a switching device in accordance with an alternative embodiment of the present invention.
Figure 4:
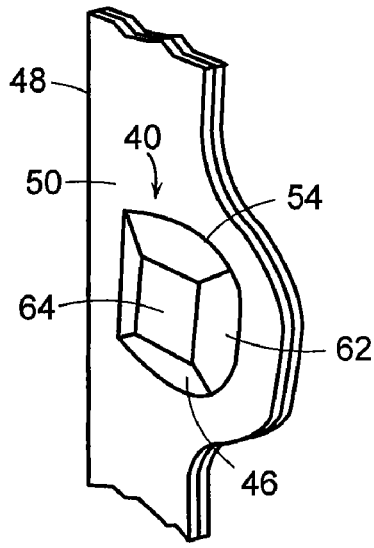
FIG. 4 is a perspective view of the switching device of FIG. 3, shown secured to storm flap of a jacket.

Another embodiment of a switch 40 is shown in FIGS. 3–4. In this embodiment, a switch 40 is positioned in between two layers of a portion of a piece of material, such as an article of clothing. Such an embodiment will allow switch 40 to be positioned in a portion of an article of apparel that extends outwardly from the remainder of the article. For example, switch 40 could be incorporated in the storm flap of a jacket that covers the jacket's zipper.

Switch 40 includes a core member 42, an electrical switch 44, and a cover 46, and is secured to a piece of material 48. Exemplary materials for core member 42 include thermoplastic elastomers and thermoplastic urethanes, thermal plastics, and thermal sets.

Switch 40 is sandwiched between a first layer 50 of material 48 and a second layer 52 of material 48. Cover 46 is formed of a first portion 54 and a second portion 56, a portion of each protruding through apertures 58, 60 formed in first layer 50 and second layer 52, respectively. In the illustrated embodiment, first portion 54 includes a flange portion 62 and a raised portion 64 extending outwardly from flange portion 62, providing tactile registration of the switch for the user. Similarly, second portion 56 includes a flange portion 66 and a raised portion 68 extending outwardly from flange portion 66. Flange portions 62, 66 are secured to the areas of first and second layers 50, 52 surrounding apertures 58, 60, respectively. Flange portions 62, 66 may be secured to first and second layers 50, 52 by direct-injection molding, adhesive, sewing, ultrasonic welding, heat welding, screw fastener, rivets, or any other suitable fastening method. Exemplary materials for cover 46 include thermoplastic elastomers and thermoplastic urethanes, thermal sets and plastics.

Electrical switch 44 is operably connected to a flexible cable 70, which in turn is operably connected to a device to be operated, such as a two-way radio, portable music player, cell phone, etc. (not shown). Electrical switch 44 is wrapped over the surface of core member 42. As discussed above with respect to FIGS. 1–2, electrical switch 44 may be a textile switch or any other suitable switch. Additionally, electrical switch 44 may comprise one or more switching elements. In the embodiment illustrated, electrical switch 44 includes a tactile response dome 72 that provides tactile and audible feedback to the user to indicate that the switch has been activated or de-activated.

In a manner similar to the embodiment discussed above with respect to FIGS. 1–2, a user grasps and pinches the sides of cover 46, thereby depressing and activating electrical switch 44, and activating the device to which switch 44 is connected. It is to be appreciated that two switching elements may be included in this embodiment as well. Tactile response domes 72 provide an indicator to the user that switch 44 has been activated and that the target device is operational. The resistance required for the user's fingers to operate switch 44 is provided solely by core member 42, electrical switch 44, cover 46, or any combination thereof.

In certain preferred embodiments, switch 40 could be recessed from or substantially flush with the surface of material 48. Ridges could also be formed in the material surrounding switch 40 to provide tactile indication for a user.

Figure 5:
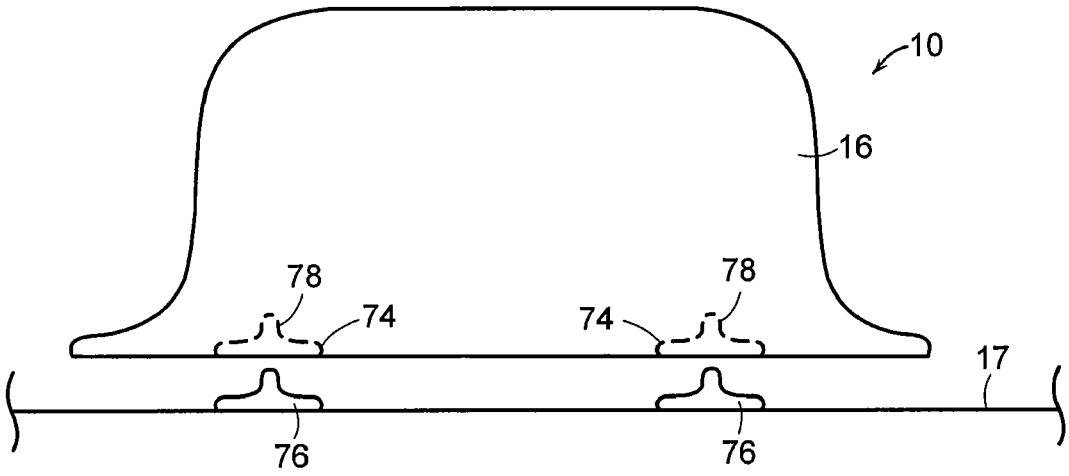
FIG. 5 is an elevation view in exploded form of an alternative embodiment of the switching device of FIG. 1, shown prior to being attached to an article of apparel.

In another preferred embodiment, as seen in FIG. 5, switching device 10 may be removably secured to material 17. This could be advantageous in situations where material 17 is an article of clothing, and switching device 10 is not made of materials that are susceptible to a washing and drying cycle. In such an embodiment, one or more fasteners 74 can be used to removably attach switching device 10 to material 17. Fasteners 74 may be, for example, metal apparel snaps having a male portion 76 and a mating female portion 78, secured to material 17 and switching device 10. It is to be appreciated that either of the male or female portion 76, 78 may be attached to either of the material 17 or switching device 10. Thus, fasteners 74 can act as electrical conductors and fasteners.

In a preferred embodiment, material 17 can include conductive textile cables (not shown), conductive screen-printed conductors, or other conductors adhered, welded or otherwise secured to material 17, which can serve to operably connect switching device 10 to the device to be operated. Other suitable fasteners for removably securing switching device 10 to material 17 will become readily apparent to those skilled in the art, given the benefit of this disclosure.

Figure 6:
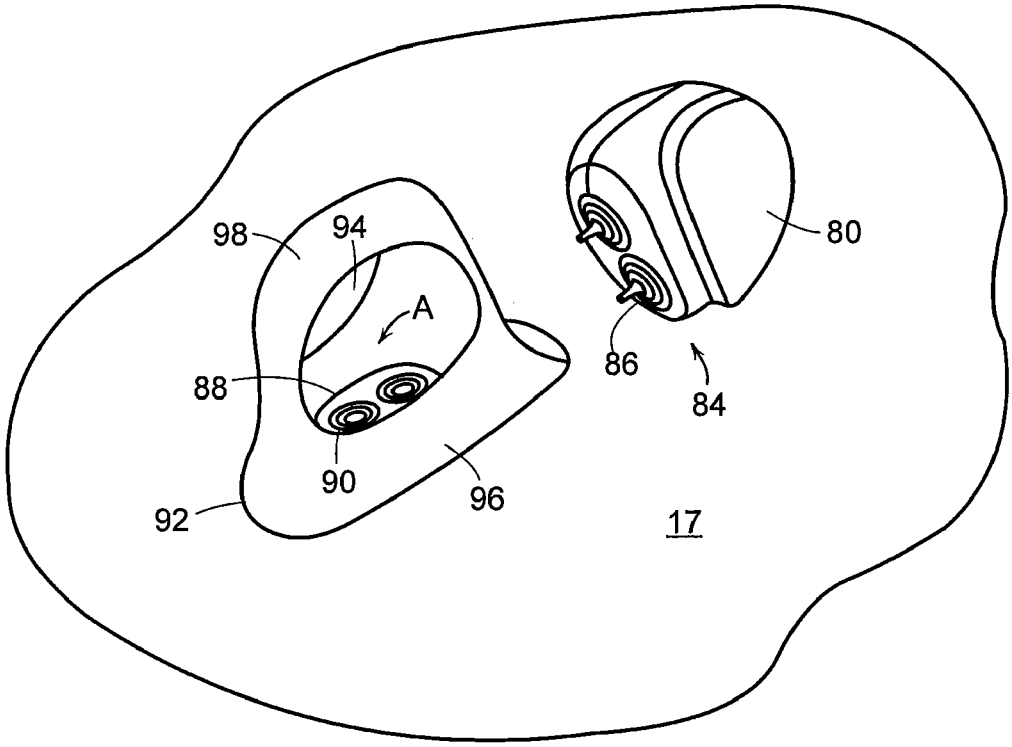
FIG. 6 is a perspective view in exploded form of an electrically operated component in accordance with the present invention, shown secured to a piece of material.

Another preferred embodiment is shown in FIG. 6, in which an electrically operated component 80 is shown in exploded form just prior to being attached to material 17 by way of a metallic snap fastener 82 in the direction of arrow A. Electrically operated component 80 may be, for example, an electrical switch as described above, or a speaker or a microphone for use with a two-way radio. Other suitable components that can be used as electrically operated component 80 will become readily apparent to those skilled in the art, given the benefit of this disclosure. A first portion 84 of metallic snap fastener 82 is secured to electrically operated component 80 and comprises a pair of male members 86. A second portion 88 of metallic snap fastener 82 is secured to material 17, and comprises a pair of female members 90. Female members 90 are in turn operably connected to a power source and or other electrical components by circuitry in material 17, such as conductive textile cables (not shown), conductive screen-printed conductors, or other conductors adhered or otherwise secured to material 17.

It is to be appreciated that the female members may alternatively be attached to electrically operated component 80 while the male members may be attached to material 17. When the male members 86 and female members 90 are snapped together, electrically operated component 80 is both secured to material 17 and electrically connected to other electrical components by way of metallic fastener 82.

In a preferred embodiment, electrically operated component 80 is also secured to material 17 by a retaining member 92, which serves to prevent accidental detachment of electrically operated component 80 from material 17. In a preferred embodiment, retaining member 92 includes a cavity 94 within which electrically operated component 80 is contained. In the illustrated embodiment, retaining member 92 comprises a base 96 and a loop 98 that forms cavity 94, and elastically retains electrically operated component 80. Retaining member 92 is preferably formed of an elastomeric material.

In light of the foregoing disclosure of the invention and description of the preferred embodiments, those skilled in this area of technology will readily understand that various modifications and adaptations can be made without departing from the scope and spirit of the invention. It is intended that all such modifications and adaptations be covered by the following claims.

What is claimed is:

1. A switching device for use on flexible material comprising, in combination:

a core member having a flange portion and a raised portion extending from the flange portion;

a switch supported by the core member and configured to be operably connected to an electrical device; and a cover, wherein resistance required to activate the switch beyond that provided by a user's fingers is provided solely by the core member, the switch, the cover, or any combination thereof.

2. The switching device of claim 1, wherein the switch comprises two switching elements operably connected in series.

3. The switching device of claim 1, wherein the switch includes a tactile response dome.

4. The switching device of claim 1, wherein the core member is formed of a thermoplastic elastomer.

5. The switching device of claim 1, wherein the core member is formed of a rigid plastic.

6. The switching device of claim 1, wherein the cover is formed of a thermoplastic elastomer.

7. The switching device of claim 1, wherein the cover is formed of rigid plastic.

8. The switching device of claim 1, wherein the core member includes a flange portion and a raised portion, the raised portion extending outwardly from the flange portion.

9. The switching device of claim 1, wherein the cover includes a flange portion and a raised portion, the raised portion extending outwardly from the flange portion.

10. The switching device of claim 1, wherein the switch is a textile switch.

11. The switching device of claim 1, further comprising a fastener for removably attaching the switching device to a flexible material.

12. A switching device for use on flexible material comprising, in combination:

a piece of flexible material;

a core member secured to the flexible material and having a flange portion and a raised portion extending from the flange portion;

a switch supported by the core member and configured to be operably connected to an electrical device; and a cover, wherein resistance required to activate the switch beyond that provided by a user's fingers is provided solely by the core member, the switch, the cover, or any combination thereof.

13. The switching device of claim 12, wherein the switch comprises two switching elements operably connected in series.

14. The switching device of claim 12, wherein the switch includes a tactile response dome.

15. The switching device of claim 12, wherein the core member includes a flange portion and a raised portion, the raised portion extending outwardly from the flange portion.

16. The switching device of claim 12, wherein the cover includes a flange portion and a raised portion, the raised portion extending outwardly from the flange portion.

17. The switching device of claim 12, wherein the switch is a textile switch.

18. The switching device of claim 12, further comprising a fastener for removably attaching the switching device to a flexible material.

19. An electrically operated component for use on flexible material comprising, in combination:

an electrically operated component;

a metallic snap fastener having a first portion secured to the electrically operated component, and a second portion configured to be secured to a piece of flexible material, the first portion comprising a first pair of metallic snap members, the second portion comprising a second pair of metallic snap members configured to mate with the first pair of metallic snap members; and a retaining member formed of an elastic material and having a cavity formed therein, the cavity configured to elastically receive the electrically operated component.

20. The electrically operated component of claim 19, wherein the first and second pairs of metallic snap members are mating male and female snap members.

* * * * *